United States Patent [19]

Moon, Jr. et al.

[11] 4,174,564

[45] Nov. 20, 1979

[54] PNEUMATIC INDICATOR DEVICE AND METHOD OF MAKING THE SAME

[75] Inventors: William T. Moon, Jr.; Arden D. Rogers; Clifford E. Goff; Harry B. Bannon, all of Knoxville, Tenn.

[73] Assignee: Robertshaw Controls Company, Richmond, Va.

[21] Appl. No.: 914,200

[22] Filed: Jun. 12, 1978

Related U.S. Application Data

[62] Division of Ser. No. 683,623, May 5, 1976, Pat. No. 4,107,492.

[51] Int. Cl.[2] ..... H01H 35/40

[52] U.S. Cl. ..... 29/622

[58] Field of Search ..... 29/622, 592; 200/81.9 M, 82 R, 82 E, 83 J, 84 C; 235/205; 116/114 K, 114 PV, 124 L

[56] References Cited

U.S. PATENT DOCUMENTS

| | | | |
|---|---|---|---|
| 2,074,895 | 3/1937 | Durant | 200/83 J |
| 2,197,473 | 4/1940 | Jackson | 200/83 J |
| 3,259,716 | 7/1966 | Nilssen | 335/205 |
| 3,302,269 | 2/1967 | Cooper | 29/622 |
| 3,322,917 | 5/1967 | Furlow | 335/205 |
| 3,429,291 | 2/1969 | Hoffman | 200/81.9 M |
| 3,431,375 | 3/1969 | Hotchkiss | 200/82 E |
| 3,462,569 | 8/1969 | Schooley | 200/81.9 M |
| 3,532,069 | 10/1970 | Morgan | 116/114 PV |
| 3,549,839 | 12/1970 | Hill | 200/81.9 M |
| 3,601,729 | 8/1971 | Hierta | 335/205 |
| 3,627,958 | 12/1971 | Liedel | 335/205 |
| 3,806,851 | 4/1974 | McCormick | 335/205 |

FOREIGN PATENT DOCUMENTS

| | | | |
|---|---|---|---|
| 733318 | 5/1966 | Canada | 116/70 |

*Primary Examiner*—Francis S. Husar
*Assistant Examiner*—Gene P. Crosby
*Attorney, Agent, or Firm*—Candor, Candor & Tassone

[57] ABSTRACT

A pneumatic indicator device having a housing carrying a movable flag that in one position thereof visually indicates one pneumatic condition of the device and in another position thereof visually indicates another pneumatic condition of the device, the housing also carrying an electrical switch which is operatively associated with the movable flag so that the switch electrically indicates the positions of the flag for remote indication purposes.

5 Claims, 7 Drawing Figures

PNEUMATIC INDICATOR DEVICE AND METHOD OF MAKING THE SAME

This application is a divisional patent application of its copending parent patent application, Ser. No. 683,623, filed May 5, 1976, now U.S. Pat. No. 4,107,492.

This invention relates to an improved pneumatic indicator device and to a method of making the same.

It is well known that various pneumatic indicator devices have been provided wherein each is adapted to visually indicate the safe or unsafe condition of a measured variable of a pneumatic control system at the control system site, the pneumatic indicator device having a movable flag which visually indicates the safe and unsafe conditions depending upon the position of the movable flag.

However, it has been found according to the teachings of this invention that with the use of computers for monitoring such control systems, there is a need for means to remotely determine the conditions of such control systems.

Accordingly, it is a feature of this invention to provide a pneumatic indicator device of the above type which also has means for remotely indicating the safe or unsafe conditions of the system being monitored by the device.

In particular, one embodiment of this invention provides a pneumatic indicator device having a housing means carrying a movable flag which in one position thereof visually indicates one pneumatic condition of the device and in another position thereof visually indicates another pneumatic condition of the device, the housing means also carrying an electrical switch means that is operatively associated with the movable flag so that the switch means electrically indicates the positions of the flag and, thus, the conditions of the device.

Accordingly, it is an object of this invention to provide an improved pneumatic indicator device having one or more of the novel features set forth above or hereinafter shown or described.

Another object of this invention is to provide a method of making such a pneumatic indicator device, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
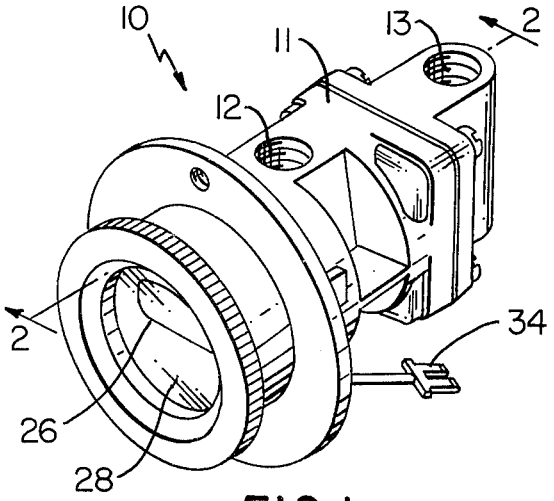
FIG. 1 is a perspective view of the improved pneumatic indicator device of this invention.

While the various features of this invention are hereinafter described and illustrated as being particularly adapted to provide a pneumatically operated indicator device, it is to be understood that the various features of this invention can be utilized singly or in any combination thereof to provide an indicator device for other systems as desired.

Therefore, this invention is not to be limited to only the embodiments illustrated in the drawings, because the drawings are merely utilized to illustrate one of the wide variety of uses of this invention.

Figure 3:
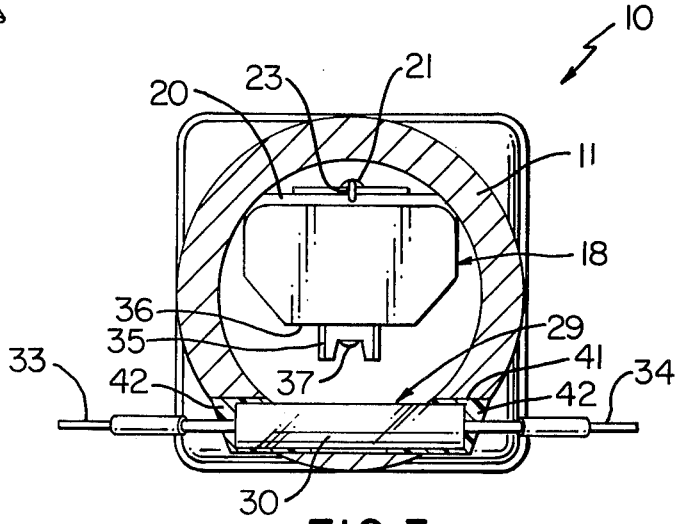
FIG. 3 is a cross-sectional view taken on line 3—3 of FIG. 2.
Figure 2:
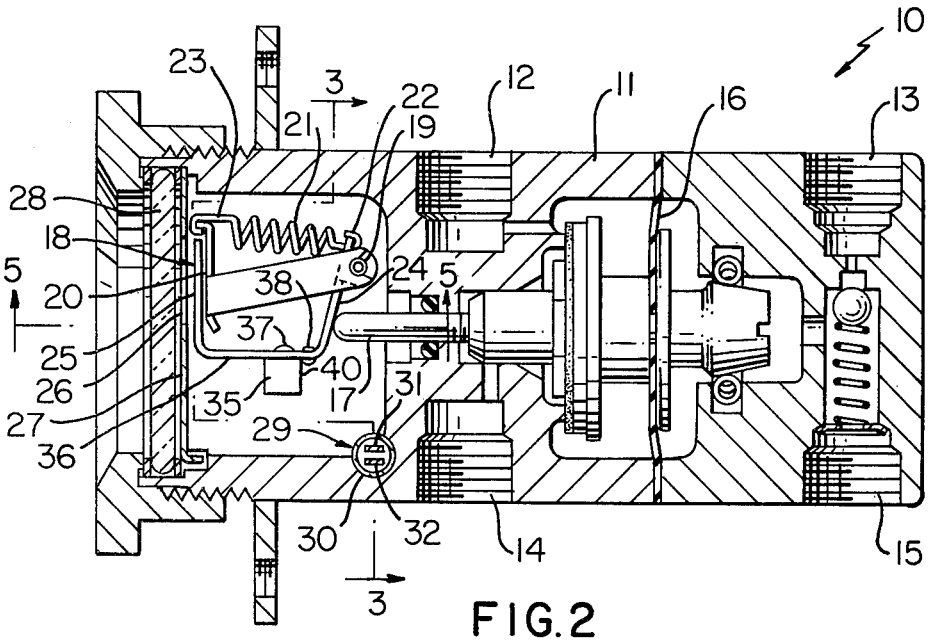
FIG. 2 is an enlarged cross-sectional view taken on line 2—2 of FIG. 1.

Referring now to FIGS. 1, 2, and 3, the improved pneumatic indicator device of this invention is generally indicated by the reference numeral 10 and comprises a housing means 11 having a plurality of ports 12, 13, 14 and 15 therein for being interconnected into a pneumatic control system in a conventional manner whereby a flexible diaphragm 16 carried by the housing means 11 determines the position of a movable plunger 17 through the action of the pressure differential created across the diaphragm 16 by the pneumatic control system in a manner well known in the art.

In particular, when the pneumatic control system being monitored by the pneumatic indicator device is in a safe condition thereof, the flexible diaphragm 16 is disposed in the safe condition illustrated in FIG. 2 to hold the movable plunger 17 in its full left-hand position as illustrated in FIG. 2. However, when an unsafe condition exists in the pneumatic control system being monitored by the pneumatic indicator device 10, the flexible diaphragm 16 is moved to the right as illustrated in FIG. 4 and carries the plunger 17 to its extreme right-hand position as is well known in the art.

Figure 4:
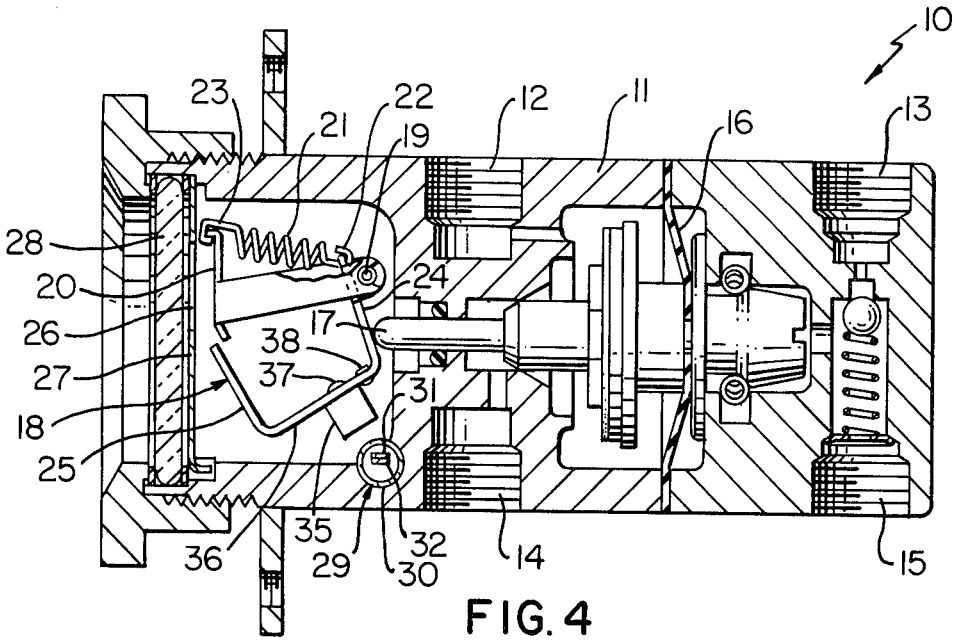
FIG. 4 is a view similar to FIG. 2 and illustrates another operating condition of the pneumatic indicator device of this invention.

A movable flag 18 is carried by the housing means 11 and is pivotally mounted thereto by a pivot pin 19 carried by a stationary flag 20, the movable flag 18 being normally biased to the position illustrated in FIG. 4 by a tension spring 21 having one end 22 interconnected to the movable flag 18 and the other end 23 interconnected to the stationary flag 20 in a manner well known in the art.

In this manner, the movable plunger 17 of the diaphragm 16 is adapted to engage against a rear part 24 of the movable flag 18 and hold the same in the position illustrated in FIG. 2 in opposition to the force of the tension spring 21 when a safe condition exists in the pneumatic control system being monitored by the device 10 whereby a front portion 25 of the movable flag 18 is exposed at a window 26 formed in a window-plate 27 disposed behind a lens 28 of the device 10 in a manner well known in the art, the front part 25 of the flag 18 covering up the stationary flag 20 when the movable flag 18 is in the safe indicating condition of FIG. 2 so that only the front part 25 of the movable flag 18 is viewable at the window 26 of the housing means 11.

However, when the diaphragm 16 is moved to the right because of an unsafe condition in the pneumatic control system being monitored by the device 10, the flag 18 pivots in a counterclockwise direction as illustrated in FIG. 4 so that the front part 25 of the movable flag 18 moves away from the window 26 of the device 11 whereby the fixed flag 20 is now exposed at the window 26 of the device 10 to visually indicate the unsafe condition of the control system, such movement of the movable flag 18 being conventional in the art.

However, as previously stated, one of the features of this invention is to provide means for remotely indicating the safe and unsafe conditions of the device 10 as illustrated respectively in FIGS. 2 and 4 and this is accomplished by utilizing an electrical switch means that is generally indicated by the reference numeral 29 in the drawings, the electrical switch means 29 comprising a conventional magnetically operated tubular switch means having a cylindrical casing 30 carrying a pair of contact means 31 and 32 normally biased apart in the manner illustrated in FIG. 2 and being respectively interconnected to external terminals 33 and 34 that can be interconnected into a desired electrical system leading to an area remote from the device 10 and the pneumatic system being monitored thereby for the reasons previously described.

At least one of the contacts 31 and 32 is movable relative to the other and is adapted to be moved into electrical contact with the other contact when a permanent magnet 35 that is carried by the flag 18 is moved adjacent to the switch casing 30 in the manner illustrated in FIG. 4 to electrically interconnect the terminals 33 and 34 together whereby an electrical circuit will be completed through the switch means 29 to remotely indicate through the appropriate electrical system the unsafe condition of the control system being monitored by the device 10. However, when the flag 18 is in the safe position illustrated in FIG. 2, the permanent magnet 35 is disposed sufficiently away from the casing 30 of the switch means 29 so that the natural bias of at least one of the contacts 31 or 32 is sufficient to maintain the contacts 31 and 32 in the open condition illustrated in FIG. 2 so that the electrical circuit cannot be completed between the terminals 33 and 34 and such safe condition is remotely indicated by the open switch means 29 in the electrical system previously described.

Figure 5:
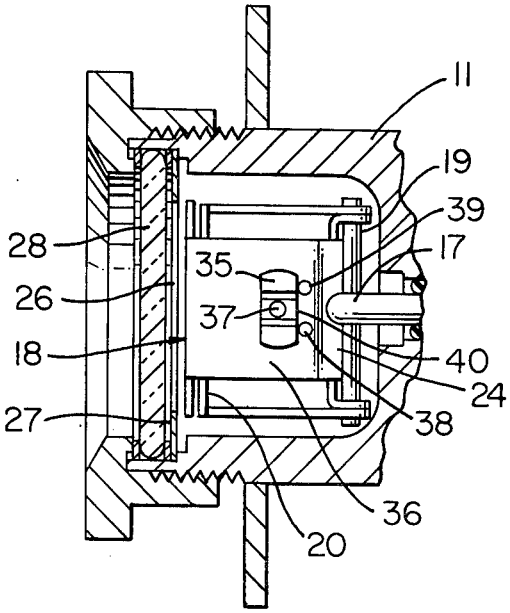
FIG. 5 is a fragmentary, cross-sectional view taken on line 5—5 of FIG. 2.

The permanent magnet 35 can be fastened to an intermediate portion 36 of the movable flag 18 by a single rivet 37 as illustrated in FIG. 5 and the intermediate portion 36 of the flag 18 can carry a pair of rivets 38 and 39 adjacent the permanent magnet 35 so as to abut a flat side 40 thereof to prevent rotational movement of the permanent magnet 35 about its single mounting rivet 37.

The housing means 11 can be transversely drilled or bored at 41, FIG. 3, to readily receive the cylindrical switch means 29 therein, the bore 31 thereafter being sealed by a suitable epoxy resin 42 to not only close the bore 41, but also to fasten the switch means 29 in the housing means 11.

Therefore, it can be seen that the pneumatic indicator device 10 of this invention can be formed in substantially its conventional manner to be simply and economically modified with the electrical switch means 29 to remotely indicate the safe and unsafe conditions of the pneumatic control system being monitored by the device 10 in a manner now to be described.

When the pneumatic indicator device 10 is coupled into a pneumatic control system by being fluidly interconnected thereto at the port means 12-15 thereof, the diaphragm 16 is held to the left as illustrated in FIG. 2 as long as the control system is in a safe pressure arrangement thereof whereby the plunger 17 is held to the left and holds the front part 25 of the flag 18 behind the window 26 of the device 10 to visually indicate the safe condition and since the permanent magnet 35 is held away from the magnetically operated switch 29, the contacts 31 and 32 thereof are in an open condition so that the electrical indicating system indicates remotely the safe condition of the system.

However, when an unsafe pressure condition exists in the control system being monitored by the device 10, the resulting pressure differential acting across the diaphragm 16 moves the same to the right as illustrated in FIG. 4 and permits the flag 18 to be rotated in a counterclockwise direction by the tension spring 21 whereby the front part 25 of the flag 18 is moved away from the window 26 so that the unsafe indicating flag 20 is now exposed at the window 26 to visually indicate the unsafe condition now present in the control system being monitored by the device 10. Also, since the permanent magnet 35 is now moved adjacent the magnetically operated switch means 29 in the manner illustrated in FIG. 4, the permanent magnet 35 causes the switch 29 to close and thereby electrically indicate the unsafe condition at a location remote from the control device 10.

Therefore, it can be seen that the control device 10 of this invention both visually and remotely indicates the safe and unsafe conditions of the device 10 as caused by the safe and unsafe conditions of the pneumatic control system being monitored thereby.

While the control device 10 has been previously described as having the permanent magnet 35 being movable with the flag 18 to control the magnetically operated switch means 29, it is to be understood that the permanent magnet could be stationary and the flag 18 could have means that could vary the influence of the magnet on the switch means 29.

Figure 6:
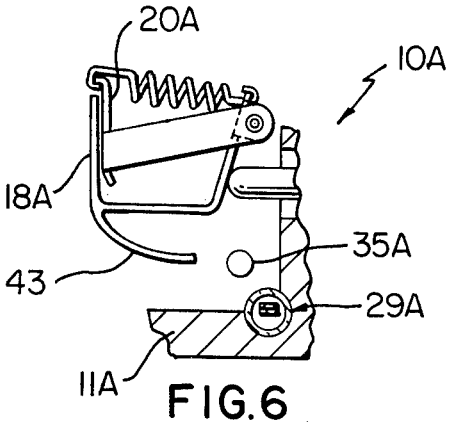
FIG. 6 is a fragmentary view similar to FIG. 2 and illustrates another embodiment of the pneumatic indicator device of this invention.
Figure 7:
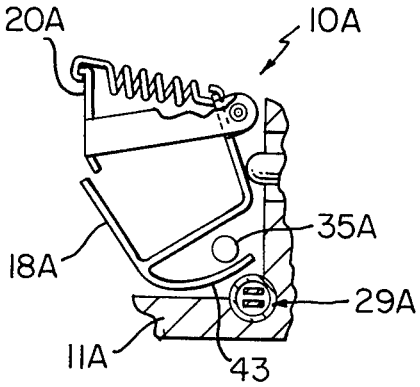
FIG. 7 is a view similar to FIG. 6 and illustrates the pneumatic indicator device of FIG. 6 in another operating condition thereof.

For example, another control device of this invention is generally indicated by the reference numeral 10A in FIGS. 6 and 7 and parts thereof similar to the device 10 previously described are indicated by like reference numerals followed by the reference letter "A."

As illustrated in FIGS. 6 and 7, the permanent magnet 35A is carried by the housing means 11A in a fixed manner relative to the magnetically operated switch means 29A so that the permanent magnet 35A normally tends to maintain the switch means 29A in a closed condition when the flag 18A is visually indicating a safe condition.

However, the flag 18A carries a member 43 of suitable magnetic material and the same is adapted to be inserted between the permanent magnet 35A and the magnetically operated switch 29A in the manner illustrated in FIG. 7 when the flag 18A is being moved to visually indicate an unsafe condition whereby the part 43 of the flag 18A diverts the magnetic flux of the permanent magnet 35A sufficiently away from the magnetically operated switch 29A so that the magnetically operated switch 29A moves to an open condition thereof to indicate the unsafe condition for the reasons previously set forth.

Therefore, it can be seen that the control device 10A operates in the same manner as the device 10 previously described except that the magnet 35A is in a fixed position and the part 43 of the movable flag 18A moves between the magnet 35A and the switch 29A to change the operating condition of the switch 29A to indicate an unsafe condition and when moved away from between the permanent magnet 35A and switch 29A, the magnet 35A can again close the switch 29A to indicate a safe condition as previously described.

Therefore, it can be seen that this invention not only provides an improved pneumatic indicator device for indicating both visually and remotely safe and unsafe conditions, but also this invention provides a method of making the improved pneumatic indicator device or the like.

While the forms and methods of this invention now preferred have been illustrated and described as required by the Patent Statute, it is to be understood that other forms and method steps can be utilized and still fall within the scope of the appended claims.

We claim:

1. In a method of making a pneumatic indicator device having a housing means carrying in a chamber thereof a movable flag that in one position visually indicates through a window means of said housing means one pneumatic condition of said device and in another position visually indicates through said window means another pneumatic condition of said device, said housing means carrying therein a pneumatically operated plunger that engages and moves said flag between said positions thereof in relation to said pneumatic conditions of said device, the improvement comprising the steps of disposing an electrical switch means in said housing means, forming said movable flag with means thereon that operates said switch means so that said switch means electrically indicates said positions of said flag, forming said housing means with a bore means passing completely therethrough in a manner to partially intersect with said chamber and receive said electrical switch means therein so that part of said switch means is exposed to said chamber, and disposing sealing means in said bore means to seal said bore means from the exterior of said housing means and secure said electrical switch means in said bore means of said housing means so that said part of said switch means is directly exposed to said chamber.

2. In a method as set forth in claim 1, the additional steps of forming said electrical switch means to be magnetically operated, and forming means on said flag for magnetically operating said switch means when said flag is in one of said positions thereof.

3. In a method as set forth in claim 2, the additional step of forming said means on said flag from a magnet to be carried by said flag.

4. In a method as set forth in claim 3, the additional steps of riveting said magnet to said flag by a single rivet, and forming said flag with two other rivets adjacent said magnet to prevent rotation of said magnet about said single rivet thereof.

5. In a method as set forth in claim 2, the additional steps of forming said means on said flag from magnetic material to be carried by said flag, disposing a fixed magnet in said housing means for operating said switch, and causing said magnet material of said flag to be disposed between said magnet and said switch to divert the magnet flux of said magnet away from said switch when said flag is in one of said positions thereof.

* * * * *